US007278243B2

(12) United States Patent
Jones et al.

(10) Patent No.: US 7,278,243 B2
(45) Date of Patent: Oct. 9, 2007

(54) MOLDING FOR SUSPENDED PANEL CEILING

(75) Inventors: Rick J. Jones, Chester Springs, PA (US); William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 122 days.

(21) Appl. No.: 11/226,506

(22) Filed: Sep. 13, 2005

(65) Prior Publication Data

US 2006/0010812 A1 Jan. 19, 2006

Related U.S. Application Data

(63) Continuation-in-part of application No. 10/890,436, filed on Jul. 14, 2004, now Pat. No. 7,240,460.

(51) Int. Cl.
*E04B 9/00* (2006.01)
*E04B 2/00* (2006.01)

(52) U.S. Cl. ..... 52/506.07; 52/506.06; 52/287.1

(58) Field of Classification Search ..... 52/506.1, 52/506.06, 506.7, 644, 512, 220.6, 287.1, 52/288.1, 716.1, 717.03, 717.04, 718.01, 52/483.1, 489.1, 762, 764, 730.6, 465, 468, 52/311.3, 664, 665, 289, 702
See application file for complete search history.

(56) References Cited

U.S. PATENT DOCUMENTS 3,486,311 A * 12/1969 Allan, Jr. ..... 55/355
4,055,930 A * 11/1977 Weinar et al. ..... 52/718.01
4,115,970 A * 9/1978 Weinar ..... 52/506.07
4,406,104 A 9/1983 Beck et al.
4,554,718 A * 11/1985 Ollinger et al. ..... 52/506.07
4,598,516 A * 7/1986 Groshong ..... 52/241
4,852,325 A * 8/1989 Dunn et al. ..... 52/733.1
5,046,294 A * 9/1991 Platt ..... 52/506.06
5,191,743 A * 3/1993 Gailey ..... 52/718.05
5,609,007 A * 3/1997 Eichner ..... 52/747.1
6,324,806 B1 * 12/2001 Rebman ..... 52/465
6,516,581 B2 2/2003 Paul et al.
6,516,582 B2 2/2003 Paul et al.
6,748,713 B2 * 6/2004 See ..... 52/506.07
2007/0022690 A1 * 2/2007 LaLonde ..... 52/506.07

OTHER PUBLICATIONS

European Patent Office Communication dated Nov. 24, 2006, accompanied by European Search Report in European Patent Application No. 06018320.0 Plus Cited References.

* cited by examiner

*Primary Examiner*—Robert Canfield
*Assistant Examiner*—Elizabeth A. Plummer
(74) *Attorney, Agent, or Firm*—Eugene Chovanes

(57) ABSTRACT

A wall molding for a panel suspended ceiling having a vertical leg that is attached to a wall, and a horizontal ledge that supports a beam extending outwardly from the wall, with the ledge having a pair of tabs and a ratchet tooth lanced from the ledge at regular intervals along the ledge that position and secure the beam end to the ledge. A cap extends over the bottom side of the ledge to hide the lanced tabs when viewed from below.

18 Claims, 6 Drawing Sheets

20
21
22
25
27
30
42
43
50
56
61
62

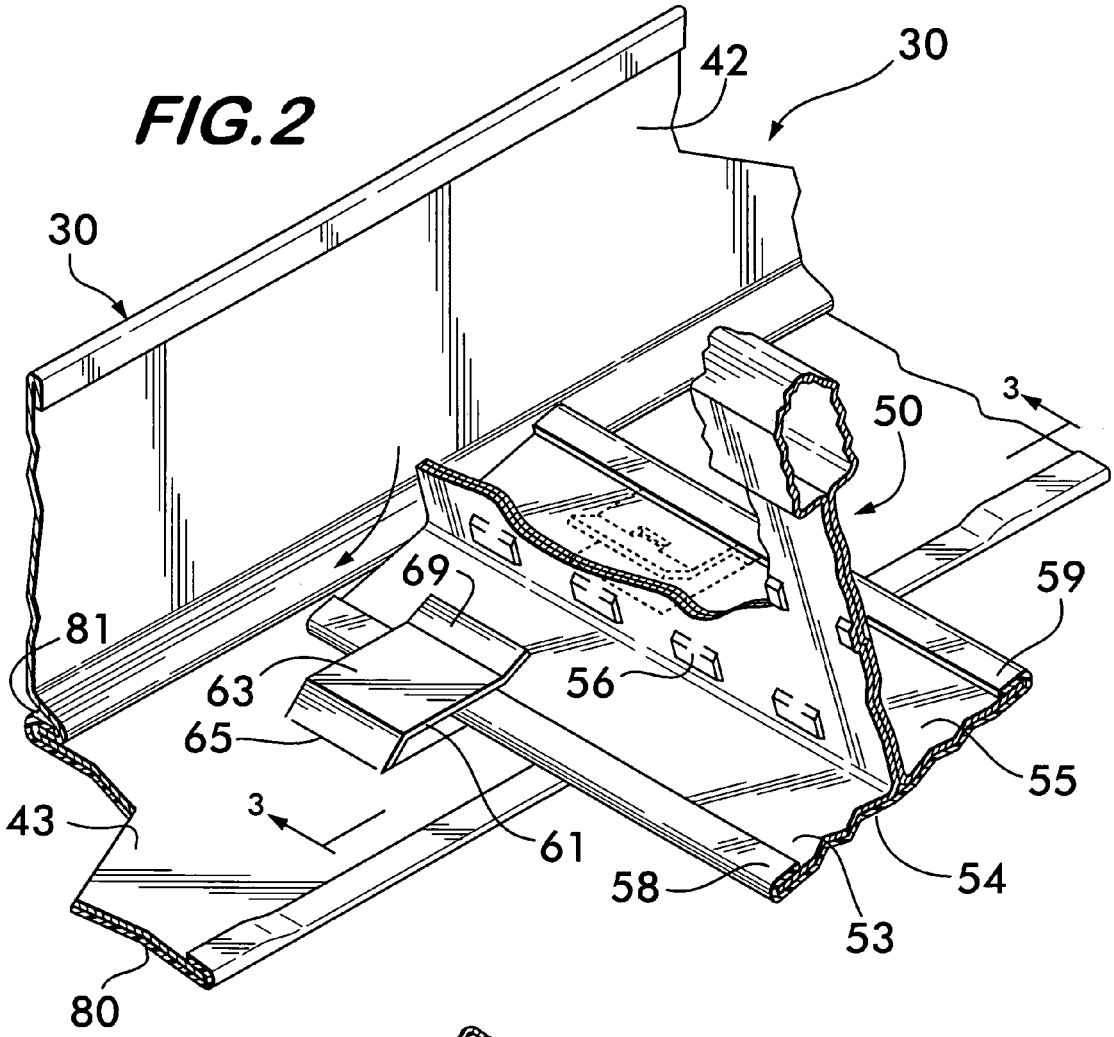
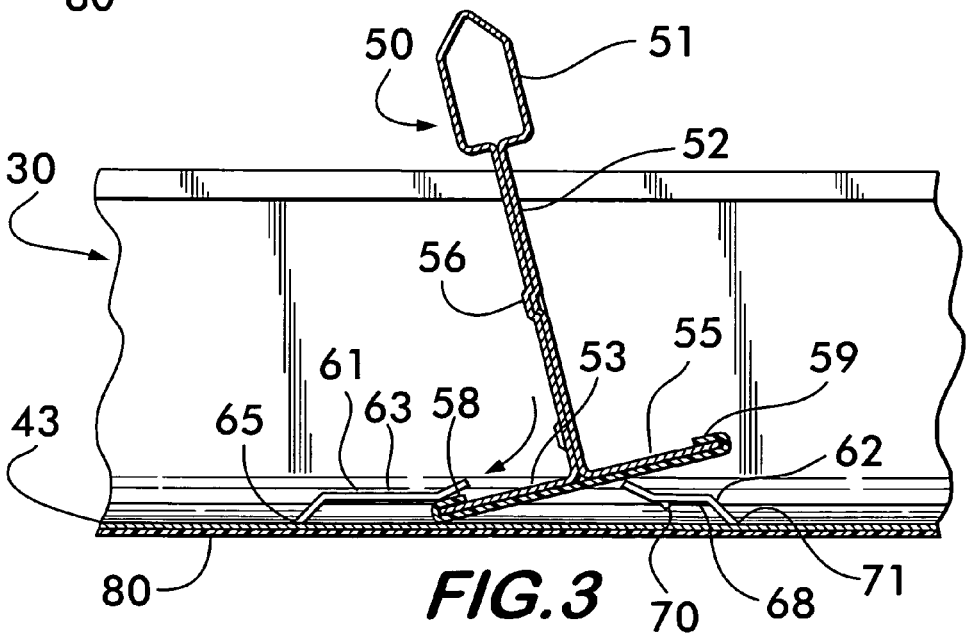
FIG.3

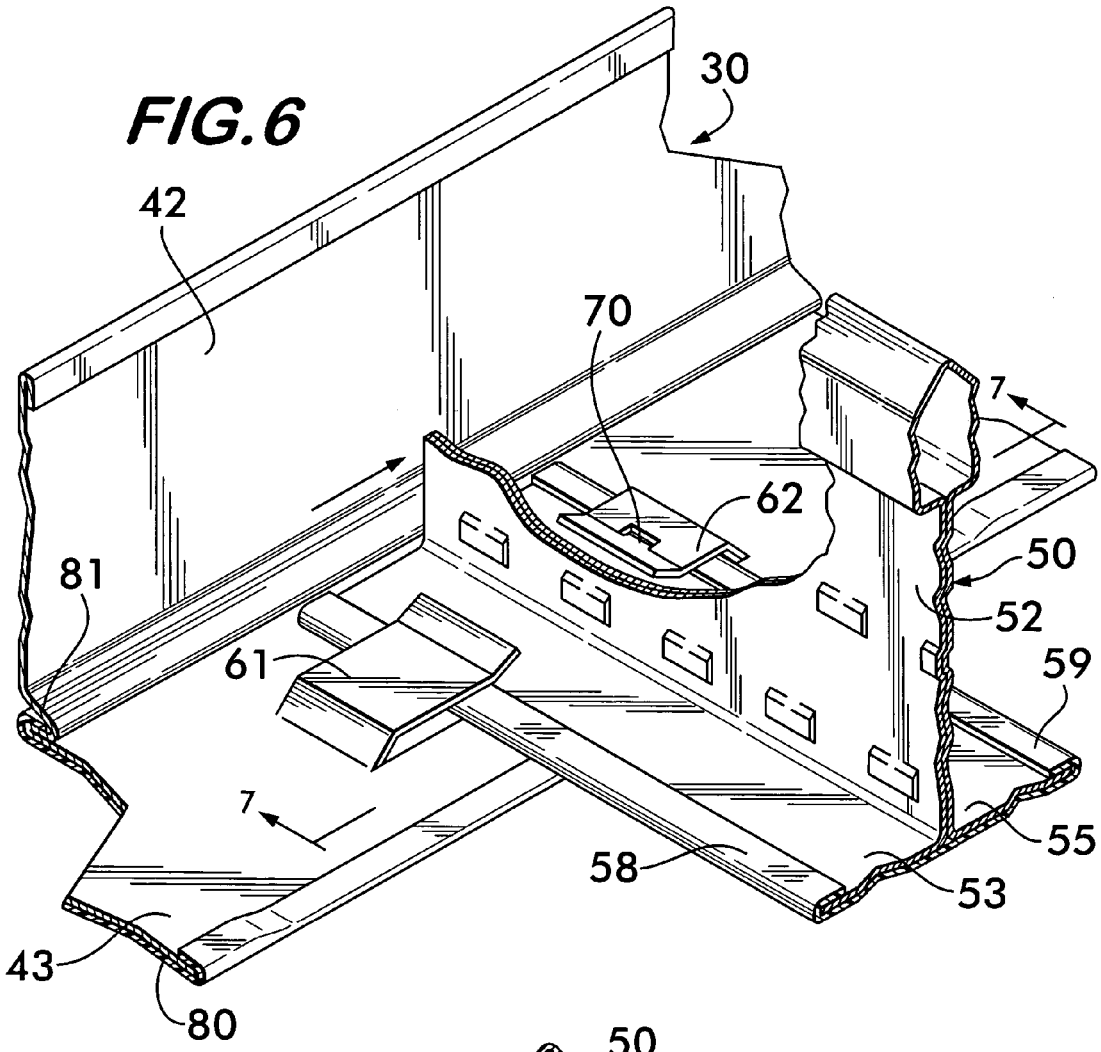
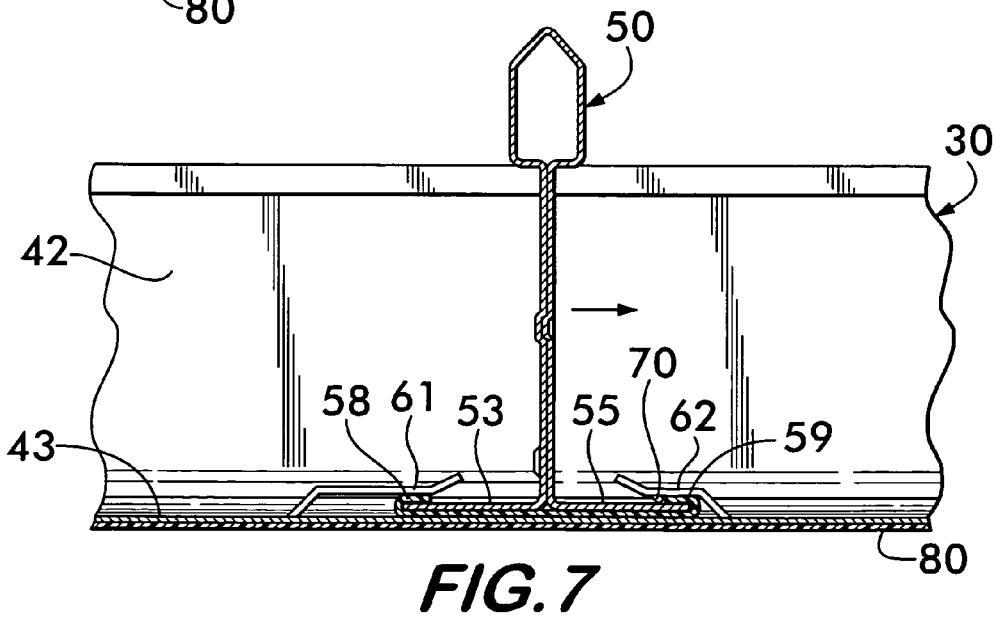
FIG. 7

FIG.8
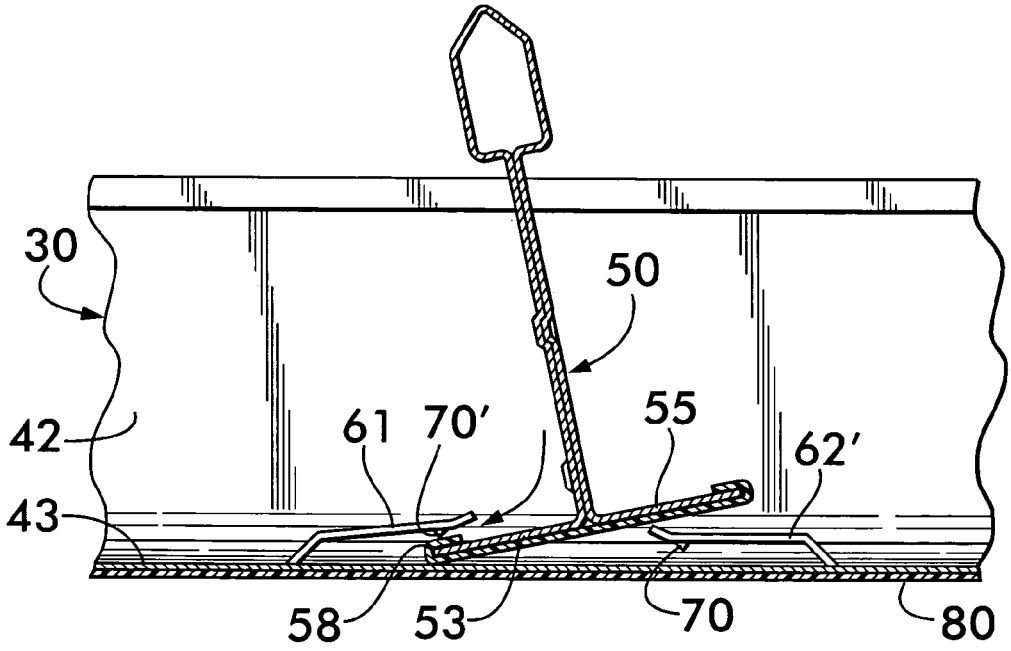
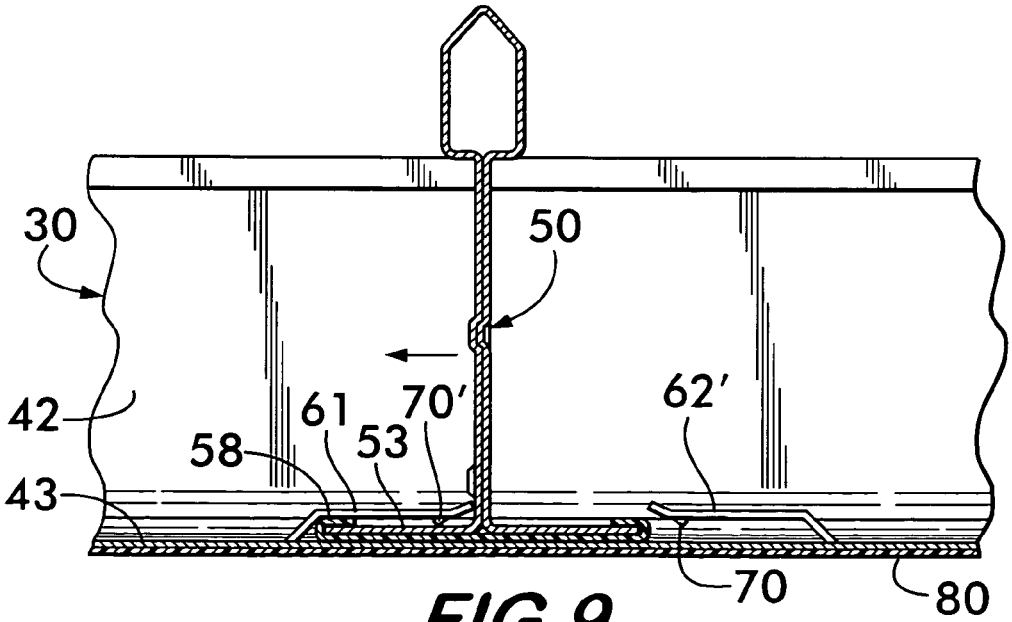
FIG.9

FIG.10
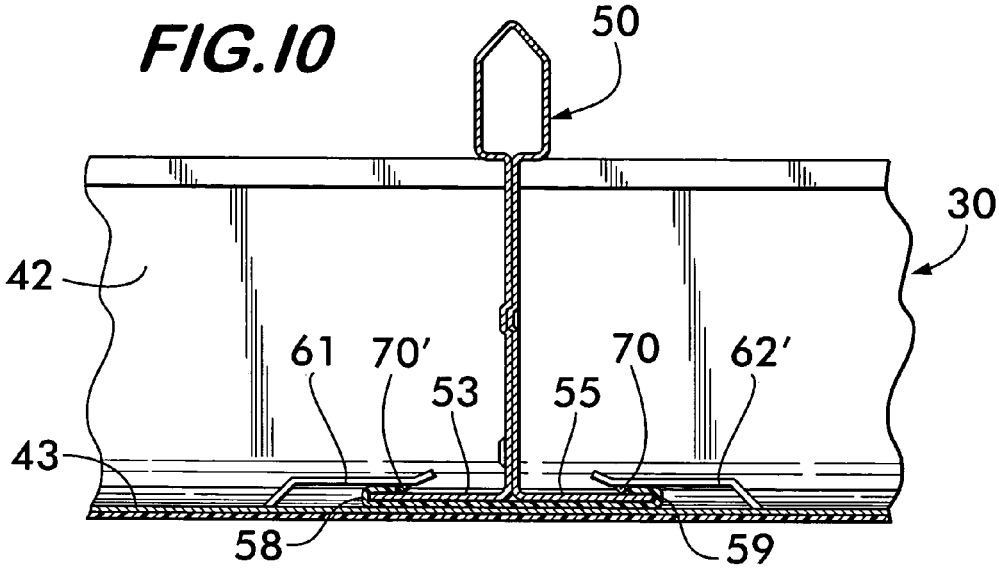
FIG.11
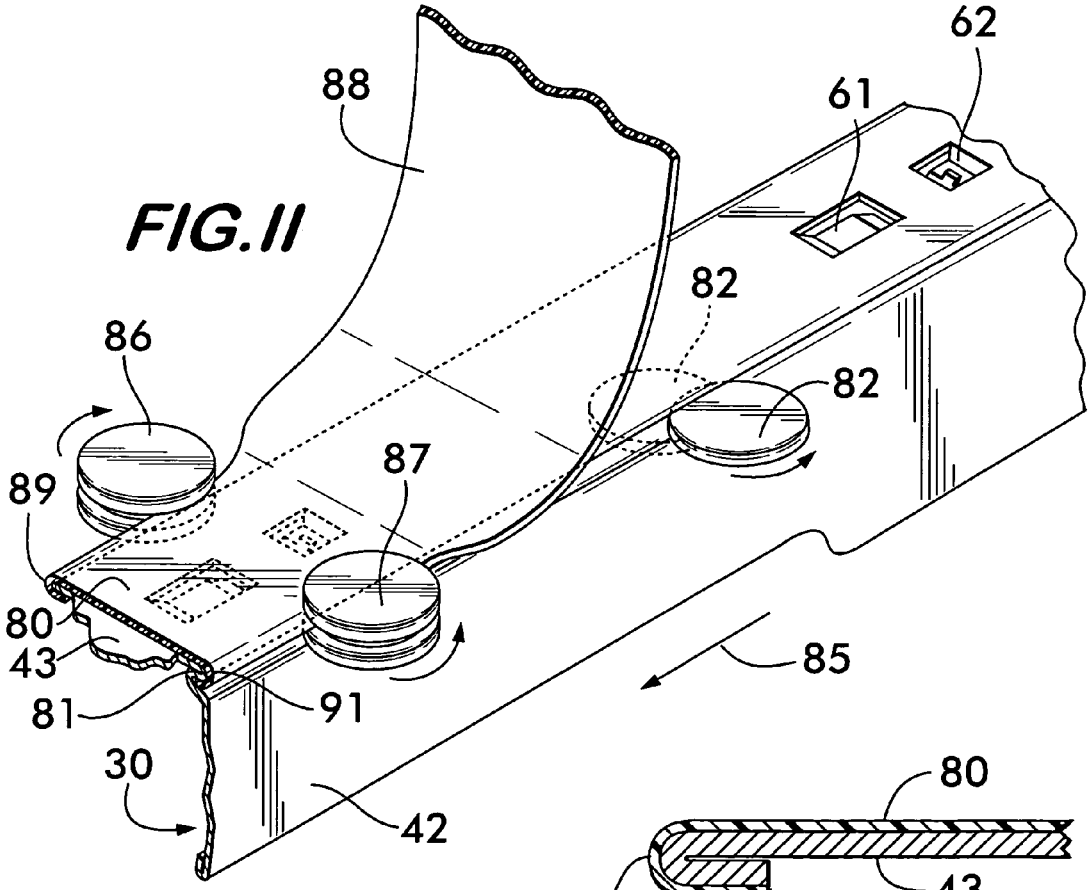
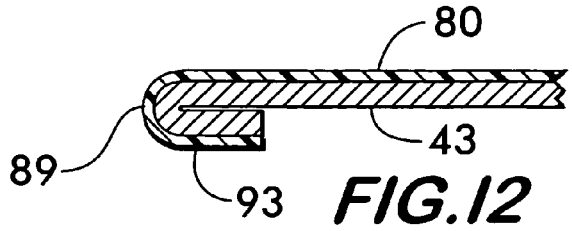
FIG.12

MOLDING FOR SUSPENDED PANEL CEILING

This application is a continuation-in-part of prior application Ser. No. 10/890,436, filed Jul. 14, 2004, now U.S. Pat. No. 7,240,460 for Molding for Drywall Ceiling Grid.

BACKGROUND OF THE INVENTION (1) Field of the Invention

The invention relates to suspended panel ceilings, and more particularly to a wall molding that supports the ends of the beams that abut the walls surrounding such ceilings.

(2) The Prior Art

The prior art includes suspended panel ceilings of a general construction and such suspended ceilings that also conform to seismic requirements.

a. Suspended Panel Ceilings of a General Construction

Panel suspended ceilings use spaced beams to support panels on flanges of the beams. The beams are rollformed from a strip of steel into an inverted T cross section with a bulb at the top, a web, and flanges extending horizontally from the bottom of the web. Generally, a bottom cover or cap extends over the bottom of the flanges, and then upward and inwardly along the edges of the flanges to form hems that secure the cap to the flanges. Main and cross beams are generally interconnected to form a grid having rectangular 2'×2' or 2'×4' openings for the panels. The beams are usually suspended with hanger wires embedded in a structural ceiling. The ends of the beams that abut the walls around the ceiling rest on ledges of angled wall moldings. The ledges of the wall moldings also support the panels along the walls.

At times, in short spans of ceiling of up to, for instance, 7 feet, as in the direction across a corridor, the beams that extend across the corridor may be supported only at their ends, on the ledges of the wall molding, without hanger wires. There may be 2 ft. long interconnected cross beams in a direction lengthwise of such corridor.

In prior art panel suspended ceilings that do not conform to any seismic code, there has generally been no fixed connection between the end of a beam and the ledge of the wall molding, since the beam merely rests on the ledge.

b. Such Suspended Panel Ceilings that Also Conform to Seismic Requirements

In suspended panel ceilings in the prior art that conform to seismic requirements, means are used to prevent the ends of the beams resting on the wall moldings from shaking off the molding during an earthquake, so that the panels in the ceilings do not fall.

Such means include stabilizer bars that run along the wall molding to keep the ends of the beams from shaking in a direction parallel to the wall, and perimeter clips on the beams which keep the ends of the beams from shaking off the molding in a direction away from the wall. Two-inch wide ledges on the wall moldings may also be used in accordance with seismic requirements, instead of perimeter clips, to prevent the ends of the beams resting on the wall molding from falling off the ledge, away from the wall, during a quake.

SUMMARY OF THE PRESENT INVENTION a. Suspended Panel Ceilings of a General Construction The wall molding of the present invention, in a panel suspended ceiling, provides a quick and accurate way of positioning, and fixing, the end of a beam abutting a wall, on the ledge of a wall molding.

As in the '436 application, which relates to drywall ceilings, referred to above, and incorporated herein by reference, the wall molding of the present invention is formed with a pair of retaining tabs, regularly spaced along the molding, lanced from the horizontal ledge of the molding, while the molding is being made. The pair of tabs work jointly, along with a single ratchet tooth in a tab in one embodiment, or a ratchet tooth in each tab in another embodiment, to position and lock the beam flanges to the ledge, by a single back and forth motion. The flanges are held downwardly against the ledge by the tabs, which are spring biased downwardly.

The wall molding of the present invention has a cover, or cap, under the bottom of the wall molding ledge, to hide the lanced portions that form the tabs in the ledge. The cap is secured on the ledge by a hem that engages a detent on one side of the ledge, and by a hem that extends over the other side of the ledge.

The angle of the wall molding of the invention can be made of heavier or stiffer metal than that of the cap that is fixed on the bottom of the horizontal ledge of the wall molding. Such heavier or stiffer metal in the angle can serve to keep the ledge stabilized in a flat plane, free of the distortion that often occurs when the vertical leg of the molding is secured to a wall with a wavering surface. The angle can be made without any color coating, and of a rougher and less expensive grade metal than the cap, since it is not seen by an observer from below. The cap, which is the only visible part of the molding to an observer from below, is formed of metal with a smooth finish and a color coat. Such a molding then blends with the underside of the flanges of the beams in the ceiling. Such beams also have color coated caps. Such a two piece construction yields a strong and attractive molding at a minimum cost.

In a first embodiment of the invention, a first flange that extends horizontally on one side of a beam, is manually slid rearwardly under a hold-down tab until a second, oppositely extending, flange on the other side of the beam clears a forwardly positioned locking tab on the ledge. The motion of the beam is then reversed to move the second flange on the beam under the locking tab. The second flange, with its upwardly extending hem, passes over a ratchet tooth in the locking tab, whereby the locking tab secures the second flange to the molding ledge, and the ratchet tooth on the locking tab prevents rearward movement, with both the first flange and second flange held downward in contact with the ledge by the downward spring bias of the tabs.

In another embodiment, each tab is associated with a ratchet tooth.

By the above-described action, the beam is locked to the wall molding at a predetermined position along the molding, in a quick and relatively easy manner.

The opposite end of the beam is likewise positioned and locked to a wall molding on the opposing wall. The moldings on opposite walls are placed in exact opposite registry, so that the beams are positioned and secured in the moldings, parallel to one another, at selected, regularly spaced, intervals.

When the wall moldings are made by rollforming, or otherwise continuously formed, the hold-down and locking tabs, and ratchet teeth, are continuously lanced from the molding ledge with suitably designed, well-known, punching machinery.

b. Such Suspended Panel Ceilings that Also Conform to Seismic Requirements

The present invention is particularly suited for seismic ceilings that support ends of both main beams and cross beams on wall moldings, as in a grid, regardless of whether the beams are primarily supported by hang wires in addition to the wall molding support, or whether supported by the wall molding alone.

The wall moldings of the invention, for seismic ceilings, use a 2" wide ledge, as in the prior art.

The 2" ledge continues, in an earthquake, to support the ends of the beams as they shake toward and away from the perimeter wall. No perimeter clips are necessary. With the present invention, the tabs restrain the ends of the beam from moving along the perimeter wall, during a quake, whereby the beams then continue to maintain their positions to support panels, and prevent the panels from falling. This eliminates any need for the use of the stabilizer bars of the prior art.

BRIEF DESCRIPTION OF THE DRAWINGS

FIG. 2 is a fragmented perspective view, taken from above, of the first flange of a beam being inserted under the rear hold-down tab of the connection, to form the embodiment of the invention shown in FIG. 1.

FIG. 3 is a cross-sectional view taken of the line 3-3 of FIG. 2.

FIG. 6 is a fragmentary perspective view, similar to FIGS. 2 and 4, showing the beam moved fully forward on the ledge 43, beneath the hold-down 61 and locking 62 tabs, with the hem of the forward flange engaged with the ratchet tooth on the forward locking tab 62, locking the beam in a forward position beneath the hold-down 61 and locking 62 tabs.

FIG. 7 is a view similar to FIGS. 3 and 5, taken on the line 7-7 of FIG. 6.

FIG. 8 is similar to FIG. 3 showing an embodiment wherein hold-down tab 61 has associated therewith a ratchet tooth 70', and locking tab 62' is as long as hold-down tab 61.

FIG. 9 is similar to FIG. 5 showing the beam 50 of FIG. 8 in a rearward position on the ledge 43.

FIG. 10 is a view similar to FIGS. 7 and 10 showing the beam 50 of FIG. 8 shifted forward to a locked position.

FIG. 11 is a fragmented perspective view, from above, of a rollforming operation that forms an indent in the vertical leg of the angle wall molding, and rolls on a cap.

FIG. 12 is a cross section of a fragment of a wall molding showing a hem on the ledge, formed from the ledge.

Figure 1:
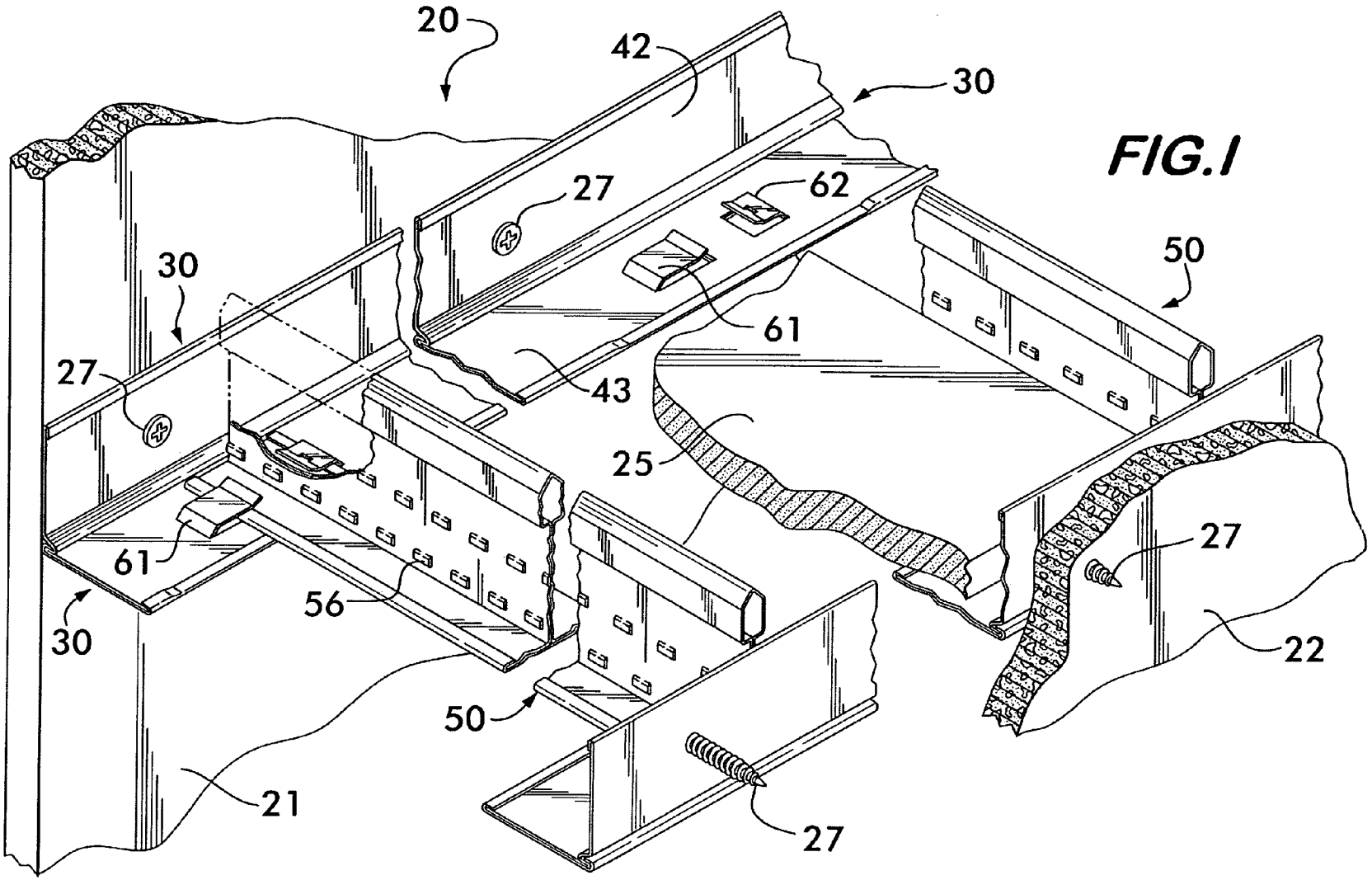
FIG. 1 is a fragmented perspective view, from above, of a suspended ceiling extending between opposing walls, showing a first embodiment of the invention.

DESCRIPTION OF THE PREFERRED EMBODIMENT a. Suspended Panel Ceilings of a General Construction As seen in FIG. 1, a panel suspended ceiling 20 extends between opposing vertical room walls 21 and 22. The ceiling 20 includes beams 50 supporting thereon panels 25. The panels 25 rest on the flanges 53,55 of beams 50. A wall molding 30 extends horizontally along walls 21 and 22 and is affixed thereton by self-tapping screws 27.

Beam 50, as well-known in the prior art, has a bulb 51, web 52, and flanges 53 and 55 extending horizontally at the bottom of web 52. The beam 50 has a cap 54 that extends over flanges 53 and 55, and is secured to the flanges by upwardly and inwardly extending hems 58 and 59. Stitches 56 secure layers of web 52 together.

Molding 30 has a vertical leg 42 and a horizontal ledge 43.

Main beams and cross beams are generally interconnected to form a ceiling grid that supports the panel.

Such ceilings are well-known in the prior art.

In the present invention, a wall molding 30, as seen in FIGS. 1 through 7, has spaced along the ledge 43 a pair of opposing tabs 61 and 62. Tab 61 forms a hold-down tab that is lanced from the ledge 43. Tongue 63 is biased downwardly toward the ledge 43. The hold-down tab 61 is integral with the ledge 43 at its pivot line 65 and then has a straight section 68 and an upturned section 69.

Positioned opposite to hold-down tab 61 is locking tab 62. Tab 62 is similar to tab 61 except tongue 63 is shorter as shown. Extending downwardly from tongue 63 of the locking tab 62 is a ratchet tooth 70 which has a slope extending away from the hold-down tab 61, toward the pivot line 71 of locking tab 62.

A cap 80 extends over the bottom of wall molding 30 so that the lanced portions of ledge 43 cannot be seen from below. The cap is desirably formed of a smooth finish metal that is color coated to match the caps of the bottom of the flanges of the beams in the ceiling. Such a cap 80 not only hides the lanced holes in ledge 43, but also gives a decorative appearance to the molding, without the expense of making the entire molding of such smooth finish that is color coated.

The cap 80 may be applied in a rollforming operation as seen in FIG. 11. An indent 81 is first formed in the bottom of the vertical leg 42 where it joins ledge 43. The indent 81 can be seen, for instance, in FIG. 2. The indent 81 is formed by rolls 82 as the molding 30 travels in the direction 85, after having tabs 61 and 62 formed in the ledge 43 by suitable punching means.

The cap 80 on the bottom of the wall molding ledge 43 is desirably made of thinner metal than that of the angled vertical leg 42 and horizontal ledge 43 of the wall molding 30, since the function of such cap 80 is primarily decorative to hide the lanced holes in ledge 43, and to provide a surface appearance, including color, on the bottom of the molding that matches the surface and color of the cap on the bottom of the beams as constructed in the prior art.

The molding 43 with the indent 81 formed therein passes between rollers 86 and 87. A web 88 of cap metal is fed into the rollers 86,87, which form hem 89 on one side of the ledge 43, and hem 91, which is formed about the indent 81.

Optionally, there may be formed, as by rollforming, along the outside edge of ledge 43, a hem 93 that is integral with, and extends upwardly and inwardly from the ledge 43 when the molding 30 is in position on a wall. Such a hem further stiffens the ledge. When such a hem 93 is formed from, and on, the edge of ledge 43, hem 91 of the cap is rollformed over such ledge hem 93. Such a hem 93 on ledge 43 is shown in FIG. 12.

The completed molding 30 then advances to a cut-off station to be cut into suitable lengths.

A typical wall molding 30 may have a vertical leg 42 and a ledge 43, each ⅞" wide. Each of the tabs 61,62 may be ½" wide in a direction across the molding 30, with a space of about ⅘" between a pair of opposing tabs 61 and 62. The distance between the pivot lines 65 and 71 of the tabs 61,62 may be about 2".

A channel wall molding may be used that is U-shaped in cross section, wherein the base of the U is attached vertically to the wall and acts as the vertical leg and the lower horizontal leg of the U acts as a ledge 43.

The beam 50 is engaged with the pair of tabs 61 and 62 and ratchet tooth 70 as seen in FIGS. 2 through 7.

In FIGS. 2 and 3, the first flange 53 of beam 50 is engaged under hold-down tab 61 as shown. In this position, the beam 50 with flanges 53 and 55 is angled so that first flange 53 can engage under the locking tab 62 as shown. Second flange 55 bears on top of locking tab 62.

Both hold-down tab 61 and locking tab 62 have a downward bias in the form of a spring action that results when the tabs 61,62 are lanced out of the steel web stock from which the angle moldings 30 are formed. The forming of angle molding by rollforming, and the steel used in the web from which the molding is formed, is well-known in the prior art.

Figure 4:
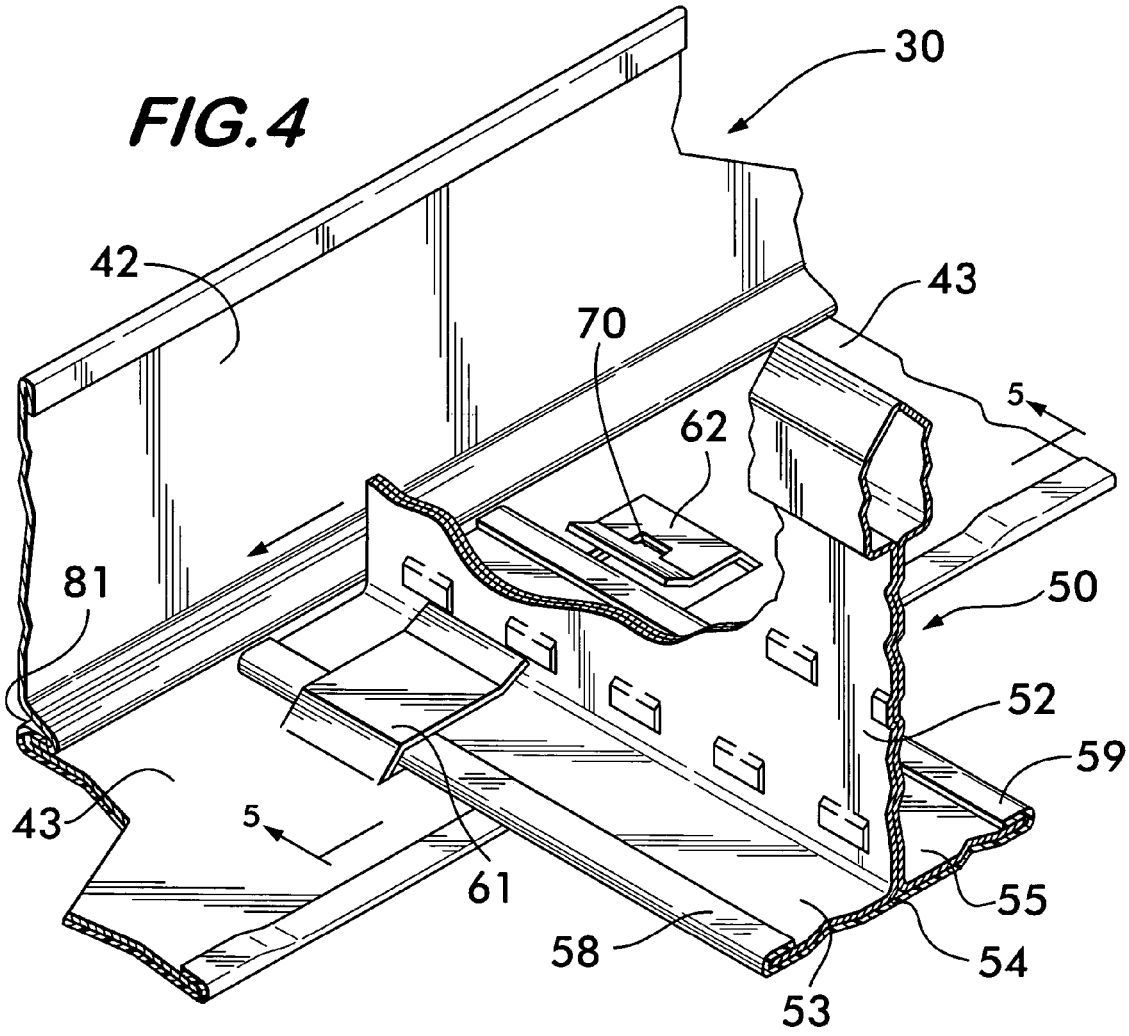
FIG. 4 is a fragmented perspective view, similar to FIG. 2, from above, showing the beam resting on the molding ledge, positioned fully rearward under the rear hold-down tab.
Figure 5:
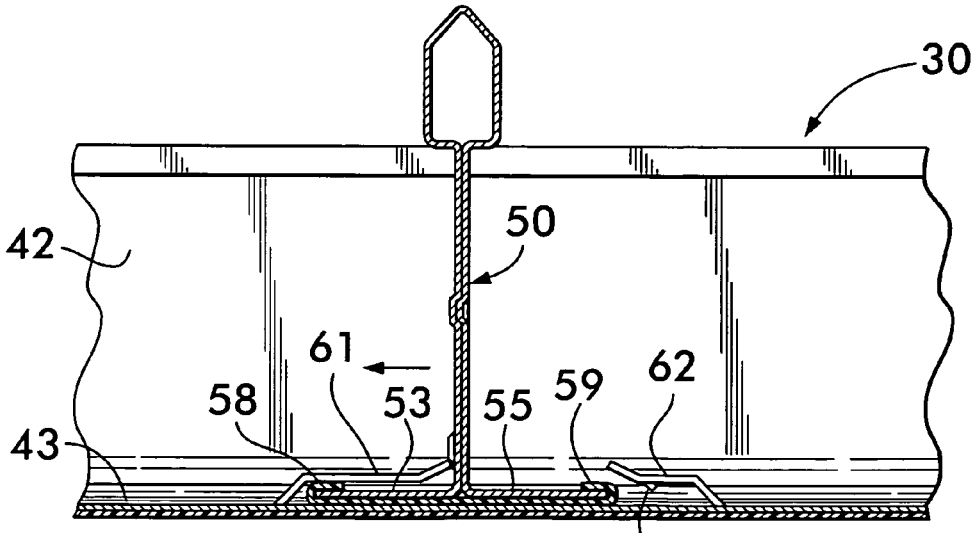
FIG. 5 is a cross-sectional view, similar to FIG. 3, taken on the line 5-5 of FIG. 4.

As seen in FIGS. 4 and 5, first flange 53 has been slid completely under hold-down tab 61, and second flange 55 has cleared locking tab 62. Flanges 53 and 55 rest on ledge 43 and are held thereto by spring biasing action of hold down tab 61.

As seen in FIGS. 4 and 5, the hold-down tab 61 must have a length deep enough to permit the first flange 53 to slide rewardly enough to permit the second flange 55 to clear locking tab 62.

As seen in FIGS. 6 and 7, beam 50, with flanges 53 and 55, is slid forward under locking tab 62 until hem 58 on the top side of flange 55 passes under ratchet tooth 70. Second flange 55 is then forced downward against ledge 43 by locking tab 62, whereby the flange 55 is locked in place from forward or rearward movement on ledge 43. Hold-down tab 61, as seen in FIGS. 6 and 7, holds down the first flange 53 against the ledge 43.

In an alternative embodiment of the invention, as seen in FIGS. 8 through 10, tab 62' is extended in length to that of tab 61, and an additional ratchet tooth 70' that slopes downwardly away from tab 62, is formed from tab 61. In this embodiment, the beam can be positioned in the tabs by a first movement in either direction, that is, initially toward tab 61, or toward tab 62'.

As shown in FIGS. 8 and 9, the first flange 53 can be first inserted under tab 61 until the hem 58 passes under ratchet tooth 70'. The beam 50 is then shifted in an opposite direction underneath tab 62' until the hem 59 on the second flange 55 engages the ratchet tooth 70, as seen in FIG. 10. In this embodiment, the beam 50 is kept from shifting forward and rearward by the combined action of the ratchet teeth 70 and 71', and the tabs 61 and 62'. The flanges 53 and 55 are again downwardly secured against the ledge 43 by the downward spring bias of the tabs 61 and 62'.

In the embodiments set forth above, the above described positioning and locking actions at opposite ends of beam 50 may occur simultaneously, if for instance, an installer is positioned at each end of the beam 50 to perform the position and securing action as described.

After a series of beams 50 are positioned and secured, as described, panels 25 of, for instance, acoustic material, are positioned on the flanges of the beams 50, to form the ceiling.

A panel 25 is supported in position in the ceiling along a wall by the wall molding ledge 43 and the flanges 53 and 55 of beams 50.

A pair of tabs 61 and 62, in the various embodiments described above, are regularly spaced along the molding ledge 43, at, for instance, 2' intervals, so that the ends of beams 50 that abut a wall can be secured at selected distance to receive panels 25. Beams 50 are locked in to wall moldings 30 that are in registry opposing walls, so that the beams 50 run across the ceiling parallel to one another.

b. Such Suspended Panel Ceilings that Also Conform to Seismic Requirements

In a ceiling that meets seismic requirements, ledge 43 is extended to a 2" width. The end of beam 50 is cut so that at rest position on the ledge, as seen for instance in FIG. 1, the end of the beam is ¾" away from vertical leg 42 of molding 30. This is in conformance generally with code requirements for a seismic ceiling. In the event of a quake, the end of the beam 50 can travel ¾" away from its rest position toward or away from the wall 21 or 22, and still be supported on the 2" ledge.

The tabs 61 and 62 again extend along the beam 50 as described above, and keep the beam end from moving along the wall 21,22 during a quake.

What is claimed is:

1. In a grid that supports panels in a suspended ceiling, the grid having (a) a wall molding extending rearward and forward along opposing parallel walls, with a vertical leg of the molding secured to the wall, and a ledge of the molding extending horizontally away from the wall, and (b) inverted T beams, each of the beams having, a bulb a web extending downwardly from the bulb, a first and second flange extending outwardly in opposite directions from the web at the bottom thereof, a cap on the bottom of the first and second flange, and a hem from the cap extending upwardly and inwardly along each outside edge of the first and second flange, with the beams supported on the ledges of the moldings on the opposing walls at opposite ends of the beams;

the improvement comprising (a) a pair of downwardly biased tabs extending above the ledge, integral with, and lanced from, the ledge of the molding, for spacing and securing the ends of the beams to the molding, wherein the tabs have open ends extending toward one another, in combination with (b) a ratchet tooth in a tab; and wherein the tabs comprise a rearward and a forward tab, and the beam is secured in the pair of tabs by sliding the first flange rearwardly beneath the rearward tab of the pair, and then sliding forward the second flange into the forward tab of the pair.

2. The grid of claim 1 wherein the ratchet tooth is formed in the forward tab.

3. The grid of claim 2 wherein the locking tab and ratchet tooth lock the second flange of the beam onto the ledge so that the beam cannot move rearward or forward along the molding.

4. The grid of claim 1 wherein a ratchet tooth is formed in each tab.

5. The grid of claim 1 wherein the ratchet tooth slopes downwardly.

6. The grid of claim 1 wherein the rearward tab is a hold-down tab, and the forward tab is a locking tab.

7. The grid of claim 1 wherein the ratchet tooth engages a hem that extends along the edge of a flange of a beam.

8. The grid of claim 7 wherein the ratchet tooth engages a hem that extends along the top edge of a flange of a beam.

9. The grid of claim 1 wherein the pair of tabs that are formed at spaced intervals along the ledges of the moldings on opposite walls are in registry with one another, so that the beams in the grid that extend from molding to opposite molding are parallel to one another.

10. The grid of claim 1 wherein the molding is rollformed and the tabs and the ratchet tooth are continuously formed during the rollforming.

11. In a wall molding for a grid in a panel suspended ceiling, the molding having a right angle in its cross section with one side of the angle capable of being affixed to a wall, and the other side of the angle capable of serving as a ledge for supporting an inverted T beam having flanges that rests on the ledge, the beam having flanges with an upwardly extending hem extending along the edges of the flange, the improvement comprising (a) repetitive pairs of tabs extending at regular intervals along the edge for securing to the ledge an inverted T-beam with flanges, wherein the tabs are lanced from the ledge and extend toward one another in open position, and (b) a ratchet tooth lanced from a tab, wherein, (a) when the ledge supports a beam, the flanges of the beam are locked to the molding ledge by the tabs and the ratchet tooth;

(b) the beam is secured in the pair of tabs by sliding the first flange rearwardly beneath a rearward tab of the pair, and then sliding forward the second flange into a forward tab of the pair; and (c) the locking tab and ratchet tooth lock a flange of the beam onto the ledge so that the beam cannot move rearward or forward along the molding.

12. The molding of claim 11 wherein the ratchet tooth engages a hem that extends along the top of the edge of a flange.

13. The molding of claim 11 wherein the pair of tabs are formed at spaced intervals along the ledges of the moldings on opposite walls, and are in registry with one another, so that the beams in the grid that extend from molding to molding are parallel to one another.

14. The molding of claim 11 wherein the molding is rollformed, and the tabs and the ratchet tooth are continuously formed in the molding during the rollforming.

15. The wall molding of claim 11, wherein there is a ratchet tooth in each tab.

16. The molding of claim 11 wherein the ledge of the angle has a hem formed along the edge away from the wall.

17. The molding of claim 16 wherein the hem is formed upwardly and inwardly by rollforming.

18. The molding of claim 1 or 11 formed from a channel that is U-shaped in cross section.

* * * * *